US006755174B2

(12) United States Patent
Kloss

(10) Patent No.: US 6,755,174 B2
(45) Date of Patent: Jun. 29, 2004

(54) INTERNAL-COMBUSTION ENGINE HAVING AUXILIARIES

(75) Inventor: Joachim Kloss, Karlsruhe (DE)

(73) Assignee: Dr. Ing. h.c.F. Porsche Aktiengesellschaft, Stuttgart (DE)

( * ) Notice: Subject to any disclaimer, the term of this patent is extended or adjusted under 35 U.S.C. 154(b) by 128 days.

(21) Appl. No.: 09/941,789

(22) Filed: Aug. 30, 2001

(65) Prior Publication Data

US 2002/0023618 A1 Feb. 28, 2002

(30) Foreign Application Priority Data

Aug. 30, 2000 (DE) ..... 100 42 408

(51) Int. Cl.[7] ..... F02B 77/00
(52) U.S. Cl. ..... 123/198 R; 123/198 C
(58) Field of Search ..... 123/198 R, 41.49, 123/195 A, 192.1, 192.2, 195 E, 198 C

(56) References Cited

U.S. PATENT DOCUMENTS 4,425,881 A 1/1984 Lyndhurst
5,203,293 A 4/1993 Shintani et al.
5,938,169 A 8/1999 Ogawa et al.
6,079,385 A * 6/2000 Wicke ..... 123/198 R
6,101,995 A 8/2000 Itoh et al.
6,164,262 A * 12/2000 Ban et al. ..... 123/198 R
6,244,239 B1 * 6/2001 Sisco et al. ..... 123/198 R

FOREIGN PATENT DOCUMENTS

DE 4121263 A1 1/1992
DE 4121263 10/1993
DE 19732370 A1 2/1999

* cited by examiner

*Primary Examiner*—Henry C. Yuen
*Assistant Examiner*—Katrina B. Harris
(74) *Attorney, Agent, or Firm*—Crowell & Moring LLP

(57) ABSTRACT

An internal-combustion engine, which is suitable for being installed in a motor vehicle, has auxiliaries including a generator and a water pump which are arranged on an exterior side of a housing structure of the internal-combustion engine. In order to construct the auxiliaries in an easily mountable manner and to advantageously accommodate them on the housing structure of the internal-combustion engine, the generator and the water pump form a constructional unit which is connected with the housing structure of the internal-combustion engine.

10 Claims, 2 Drawing Sheets

INTERNAL-COMBUSTION ENGINE HAVING AUXILIARIES

BACKGROUND AND SUMMARY OF THE INVENTION

This application claims the priority of German Patent Application 100 42 408.2, filed in Germany, Aug. 30, 2000, the disclosure of which is expressly incorporated by reference herein.

The invention relates to an internal-combustion engine, preferably for a motor vehicle, having auxiliaries, which auxiliaries comprise, for example, a generator and a water pump.

In the case of a known internal-combustion engine—U.S. Patent Document U.S. Pat. No. 4,425,881—of the initially mentioned type, several auxiliaries are arranged on the exterior side of a housing of this internal-combustion engine. Thus, a water pump is mounted on a longitudinal side of the housing; a generator is mounted adjacent to a front end of the above-mentioned housing.

In German Patent Document DE 41 21 263 C2 (corresponding U.S. Pat. No. 5,203,293), several auxiliaries are arranged above one another on a longitudinal side of an internal-combustion engine housing and are fastened on this housing by means of holding brackets mounted at a distance from one another. The drive of the auxiliaries takes place by means of a wrap-around drive from a crankshaft of the internal-combustion engine.

It is an object of the invention to construct auxiliaries of an internal-combustion engine in an easily mountable manner and to arrange them in a spatially advantageous manner on a housing structure of the internal-combustion engine.

According to the invention, this object is achieved by an internal-combustion engine for a motor vehicle having auxiliaries which comprise a water pump and a generator, which water pump and generator are arranged on an exterior side of a housing structure of the internal-combustion engine, wherein the water pump and the generator form a constructional unit which is connected with housing structure of the internal-combustion engine.

Additional features of preferred embodiments of the invention described herein and in the claims.

Important advantages achieved by means of the invention are that the constructional unit, which is formed by the generator and the water pump, can have a compact design and can therefore be mounted in a perfect manner on the internal-combustion engine, specifically with a relatively small space requirement. In this case, the constructional unit can be constructed as a prefabricated module whose mounting on the housing of the internal-combustion engine is simple.

Known materials, particularly metallic materials, and manufacturing processes, for example, casting, are suitable for producing the receiving housing for the auxiliaries. The water pump, which can be driven by means of a spur gear drive by the crankshaft, is surrounded by the receiving housing according to the function. The bearing sections for the generator are expediently constructed as a component of the receiving housing and ensure not only that it is easy to mount but also, as required, can be adjusted with respect to the belt tension.

Other objects, advantages and novel features of the present invention will become apparent from the following detailed description of the invention when considered in conjunction with the accompanying drawings.

DETAILED DESCRIPTION OF THE DRAWINGS

Figure 1:
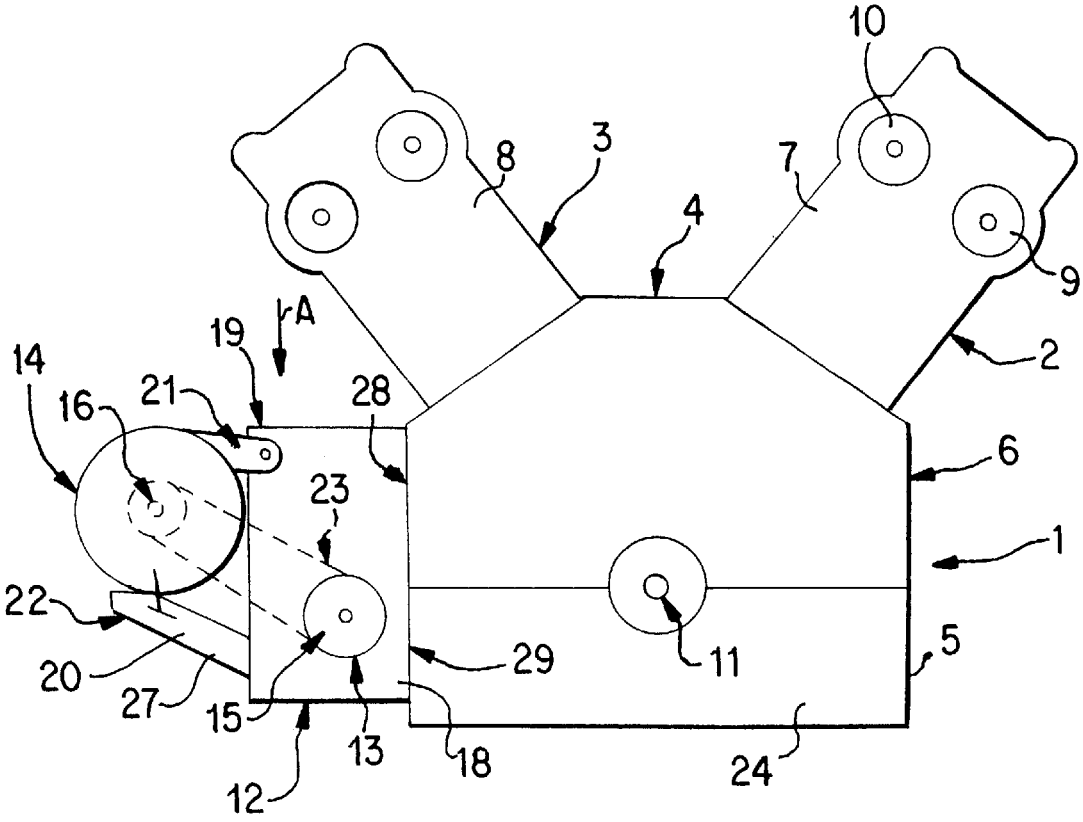
FIG. 1 is a schematic view of a front end of an internal-combustion engine constructed according to a preferred embodiment of the invention.
Figure 2:
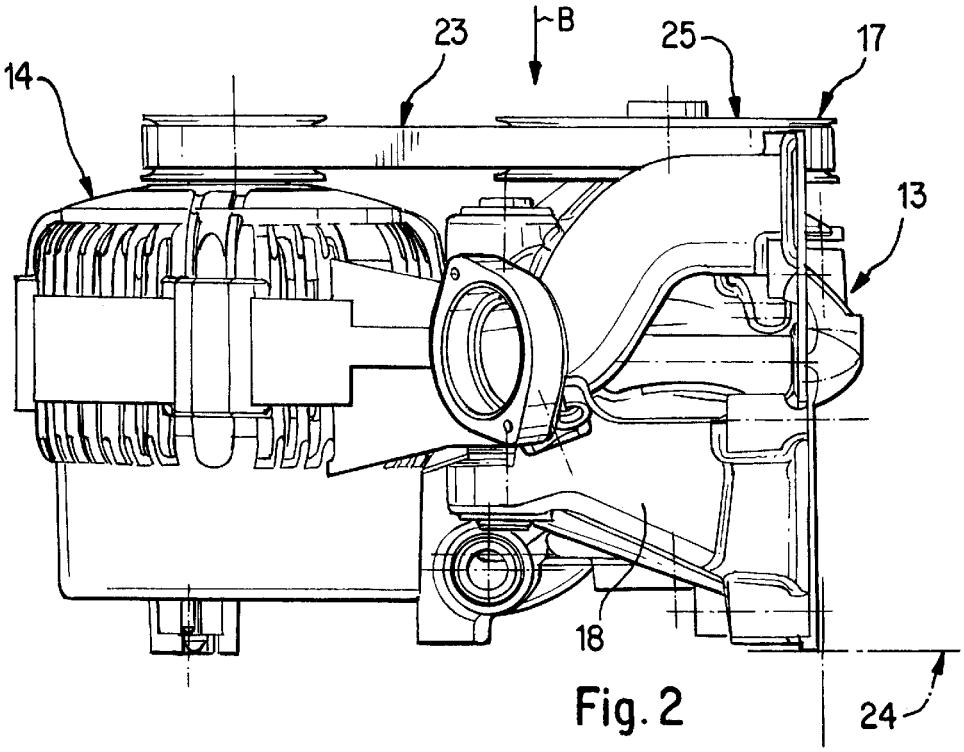
FIG. 2 is an enlarged partial view of FIG. 1 in the direction of the arrow A.
Figure 3:
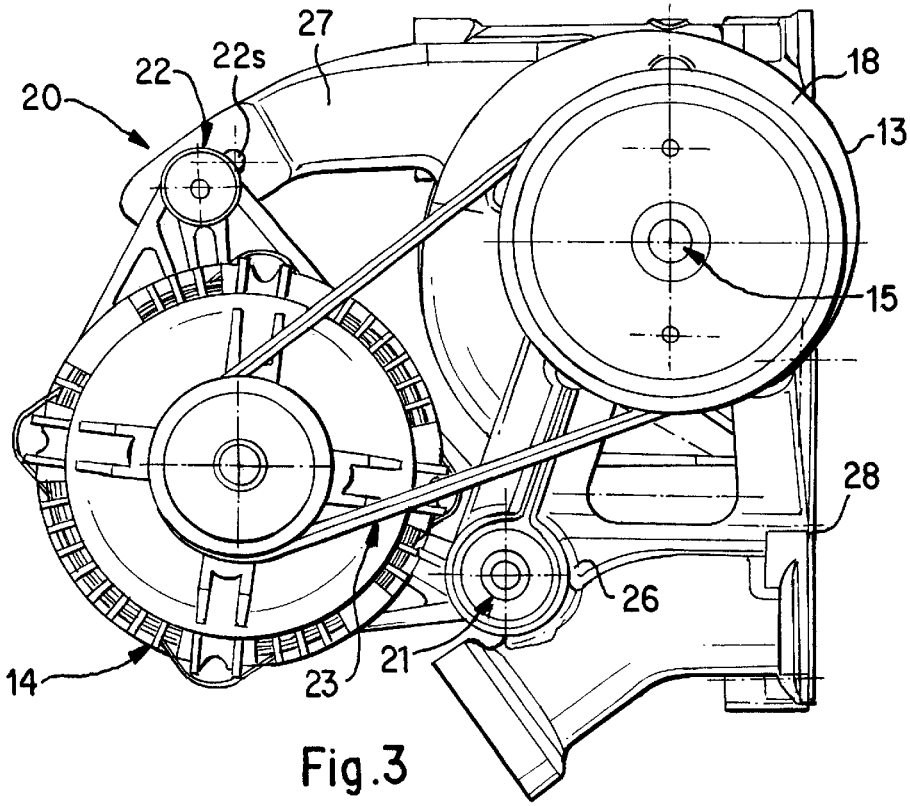
FIG. 3 is a view in the direction of the arrow B of FIG. 2 and showing the arrangement inverted as compared to the FIG. 1 illustration.

An internal-combustion engine 1 of the reciprocating type having several cylinders is suitable for the installation into a motor vehicle, which is not shown in detail, and has two cylinder banks 2, 3 arranged in a V-shape. The cylinder banks 2, 3 are components of a housing structure 4 which is formed by a crankcase bottom part 5, a crankcase top part 6 and cylinder housings 7, 8. Each cylinder housing carries camshafts 9, 10 schematically depicted for cylinder housing 7 in FIG. 1. A crankshaft ii extends along an axis between the crankcase bottom part 5 and the crankcase top part 6. This crankshaft ii is outlined only with respect to its position and transmits the power generated by the cylinders to a transmission—not shown—and furthermore drives auxiliaries 12. The auxiliaries include a water pump 13 and a generator 14 which are arranged on an exterior lateral side of the housing structure 4 with respective axes of rotation 15, 16 extending axially parallel to the crankshaft 11. Further auxiliaries can also be provided for the motor.

The water pump 13 and the generator 14 are combined to form a modular constructional unit 17 which is connected with the housing structure 4 of the internal-combustion engine 1. The constructional unit 17 comprises a receiving housing 18 for the water pump 13 and the generator 14, which receiving housing 18 surrounds the water pump 13 and is provided with bearing sections 19, 20 for the generator 14. The bearing sections 19, 20 are formed by a swivel bearing 21 and an adjusting bearing 22. The adjusting bearing 22 is used for adjusting the tension of a wrap-around drive 23 which is operative between the water pump 13 and the generator 14. For this purpose the cantilever bracket section 27 of receiving housing 18 has an adjusting slot 22S. In the embodiment shown, the wrap-around drive 23 is formed as the belt drive. The water pump 13 is driven by the crankshaft 11 by means of a spur gear—not shown—which extends adjacent to a front end 24 of the housing structure of the internal-combustion engine 1. In contrast, the wrap-around drive 23 extends on a side 25 of the constructional unit 17 (housing 18) which faces away from the front end 24.

The swivel bearing 21 is provided on a console 26 of the receiving housing 18 consisting of a metallic casting or another suitable material, and the adjusting bearing 22 is formed by a cantilever 27. The console 26 as well as the cantilever 27 are produced in one piece with the receiving housing 18. Finally, the receiving housing 18 also has an upright or vertical first connection wall 28 which is joined to a corresponding second connection wall 29 extending between the crankcase bottom part 5 and the crankcase top part 6 of the housing structure 4.

The invention is not limited to the construction described and illustrated, that is, the constructional unit 17 consisting of the water pump 13 and the generator 14. Other embodiments are contemplated which combine auxiliaries including an air-conditioning compressor and an oil pump or more than two auxiliaries of different types into a constructional unit for mounting to the engine housing in a manner corresponding to that described above for the constructional unit 17.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed:

1. Internal-combustion engine for a motor vehicle having auxiliaries which comprise a water pump and a generator, which water pump and generator are arranged on an exterior side of a housing structure of the internal-combustion engine, wherein the water pump and the generator form a constructional unit which is connected with the housing structure of the internal-combustion engine, wherein the constructional unit has a receiving housing for the water pump and the generator, wherein the receiving housing surrounds the water pump and is provided with bearing sections for the generator, and wherein the bearing sections are formed by a swivel bearing and an adjusting bearing.

2. Internal-combustion engine according to claim 1, wherein the swivel bearing is provided on a console of the receiving housing.

3. Internal-combustion engine according to claim 1, wherein the adjusting bearing is provided on a cantilever of the receiving housing.

4. Internal-combustion engine according to claim 1, wherein the receiving housing extends by a first connection wall to a second connection wall of the housing structure of the internal-combustion engine.

5. Internal-combustion engine according to claim 1, wherein a wrap-around belt drive is operative between the water pump and the generator.

6. Internal-combustion engine according to claim 5, wherein the wrap-around drive extends on a side of the receiving housing which faces away from an end of the internal-combustion engine.

7. A vehicle engine assembly comprising:

an engine crankshaft with a crankshaft rotational axis, an engine housing supporting the crankshaft and having an engine housing side wall extending substantially parallel to the crankshaft axis, a water pump which in use is operably driven by the engine crankshaft and has a first auxiliary rotation axis, a generator which in use is operably driven by the engine crankshaft and has a second auxiliary rotation axis, and a housing supporting said water pump and said generator with said first and second auxiliary rotation axes extending parallel to the crankshaft axis, wherein said housing, said water pump, and said generator are combined to form a constructional unit which is attached in use to the engine housing side wall, wherein said housing encloses the water pump and is equipped with bearing sections for the generator, and wherein the bearing sections are formed by a swivel bearing and an adjusting bearing.

8. A vehicle engine assembly according to claim 7, wherein a connection wall of the housing is attached directly to the engine housing side wall.

9. A vehicle engine assembly according to claim 7, wherein the swivel bearing is provided on a console of the housing.

10. A vehicle engine assembly according to claim 7, wherein the adjusting bearing is provided on a cantilever of the housing.

* * * * *